US005429473A

United States Patent [19]

Müller et al.

[11] Patent Number: 5,429,473

[45] Date of Patent: Jul. 4, 1995

[54] MECHANISM FOR REMOVING DOUBLE PARTS FROM THE LAST MACHINING STAGE OF A PRESS

[75] Inventors: Sieghard Müller, Ottenbach; Gerald Mikusch, Göppingen, both of Germany

[73] Assignee: L. Schuler GmbH, Germany

[21] Appl. No.: 991,211

[22] Filed: Dec. 15, 1992

[30] Foreign Application Priority Data

Dec. 20, 1991 [DE] Germany ..... 41 42 298.8

[51] Int. Cl.[6] ..... B65G 25/02

[52] U.S. Cl. ..... 414/751; 72/405; 198/468.6

[58] Field of Search ..... 414/749, 751; 72/422, 72/419, 405; 198/468.2, 468.6

[56] References Cited

U.S. PATENT DOCUMENTS

| | | | |
|---|---|---|---|
| 3,757,961 | 9/1973 | Jacobs | 414/751 X |
| 4,032,018 | 6/1977 | Wallis | 414/751 X |
| 4,735,303 | 4/1988 | Wallis | 414/751 X |

FOREIGN PATENT DOCUMENTS

| | | |
|---|---|---|
| 1452769 | 5/1969 | Germany . |
| 3712838 | 11/1988 | Germany . |

*Primary Examiner*—Donald W. Underwood
*Attorney, Agent, or Firm*—Evenson, McKeown, Edwards & Lenahan

[57] ABSTRACT

A mechanism for removing double parts from the last machining stage of a press includes telescopically slidable pipes. In order to house the supporting elements of a supporting device, which are used for the support of sheet metal parts in areas situated away from the gripper rails and in the center with respect to the gripper rails, the telescopically slidable pipes are connected between the gripper rails. The pipes extend in the direction of the opening and closing movement of the gripper rails and, in the area situated in the center with respect to the gripper rails carry a bushing. The center position of the bushing is caused by stand-side guiding devices. The bushing is provided with the supporting elements which in the last machining stage of the press support the separated sheet metal parts.

3 Claims, 2 Drawing Sheets

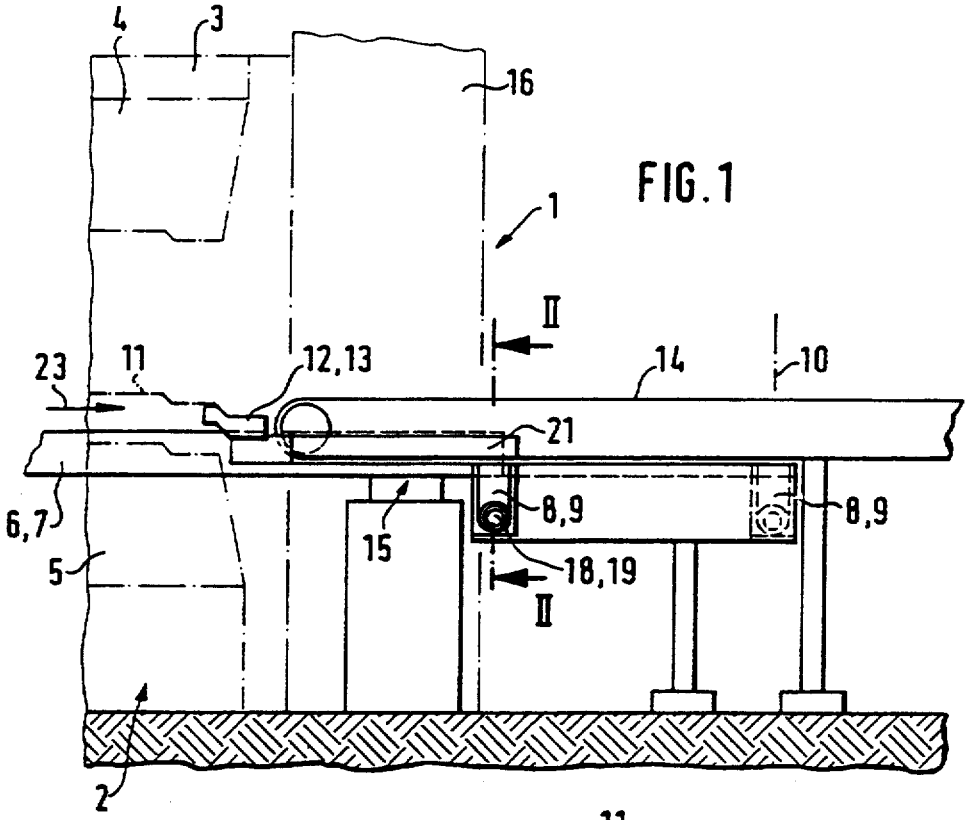
FIG. 1
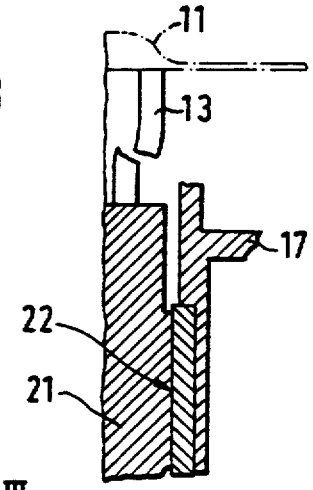
FIG. 3
FIG. 2
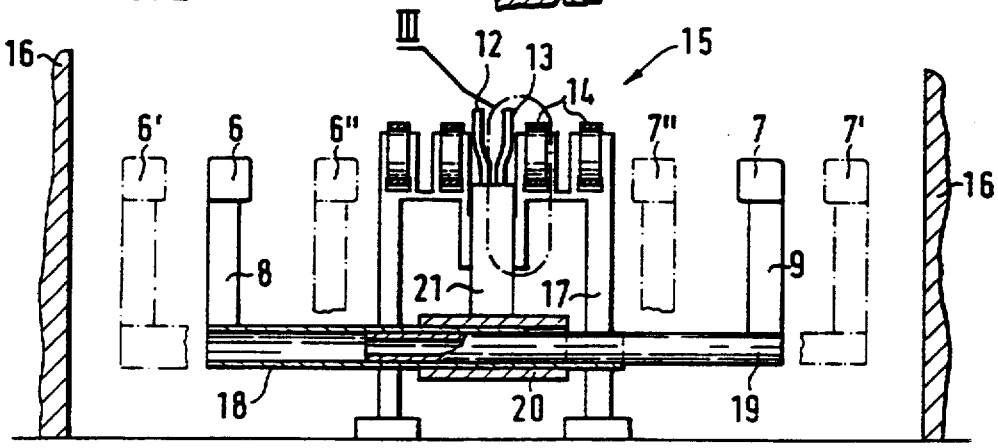

V
V

MECHANISM FOR REMOVING DOUBLE PARTS FROM THE LAST MACHINING STAGE OF A PRESS

BACKGROUND AND SUMMARY OF THE INVENTION

The present invention relates to a mechanism for removing double parts from the last machining stage of a press. The removal mechanism comprises two gripper rails which can be moved in three axes for the transfer movement of sheet metal parts and the return movement in the machining stages of the press. When double parts are to be removed from the last machining stage of the press, they must be supported in the areas which are away from the gripper rails and are situated in the center with respect to the gripper rails.

For this purpose, the German Patent Document DE 37 12 838 C2 provides a traverse which is disposed in guides on the gripper rails so that it can be moved transversely with respect to the transport direction. A part supporting device is arranged on the traverse. In the guides situated on the outside, the traverse is held in the center with respect to the gripper rails. In the case of a smaller basic gripper rail adjustment, for example, for smaller sheet metal parts, the traverse projects beyond the gripper rails during the whole service life.

By contrast, an object of the present invention is to house all the supporting devices in the area between the gripper rails.

This and other objects are achieved by the present invention which provides a mechanism for removing double parts from a last machining stage of a press, this mechanism interacting with two gripper rails, which are moveable in three axes, of a transfer device for sheet metal parts through the press. The mechanism comprises supporting elements which reach under the sheet metal parts and are moveable along with the gripper rails in lifting and lowering directions and in transfer and return directions. An outer pipe and an inner pipe are fitted at one end into one another telescopically so as to be able to be slidable into one another in a direction transverse to a passing through direction of the press between the gripper rails and are firmly connected with the gripper rails by means of the ends which are away from the telescopic connection. A bushing is disposed in a transversely slidable manner on at least one of the pipes and carries the supporting elements. At least one running surface for the center supporting position of the bushing is provided, this running surface being formed between the bushing and at least one of an attachment fastened on the bushing and a part which is fixed to a stand.

The objects are also achieved by another embodiment of the present invention which provides a mechanism for removing double parts from a last machining stage of a press, this mechanism interacting with two gripper rails, which are moveable in three axes, of a transfer device for sheet metal parts through the press. In this embodiment, the mechanism comprises supporting elements which reach under the sheet metal parts and are moveable along with the gripper rails in lifting and lowering directions and in transfer and return directions, and an outer pipe and an inner pipe which are fitted at one end into one another telescopically so as to be able to be slidable into one another in a direction transverse to a passing through direction of the press between the gripper rails. The inner and outer pipes are firmly connected with the gripper rails by means of the ends which are away from the telescopic connection. A bushing is disposed in a transversely slidable manner on at least one of the pipes and carries the supporting elements. A guiding rail is coupled to the gripper rails so as to move along with the gripper rails. A guide bar is coupled to the bushing and is slidably disposed in the guiding rail. Parallel rods are articulated on each of the gripper rails and the guide bar to form a double parallel control arrangement for the guiding rail.

The objects are also achieved by still another embodiment of the invention which provides a mechanism for removing double parts from a last machining stage of a press, this mechanism interacting with two gripper rails, which are moveable in three axes, of a transfer device for sheet metal parts through the press. In this embodiment, the mechanism comprises supporting elements which reach under the sheet metal parts and are moveable along with the gripper rails in lifting and lowering directions and in transfer and return directions. A first toothed rack and a second toothed rack are provided which extend transversely with respect to a passing-through direction of the press and in parallel to one another between the gripper rails, each toothed rack being fastened at one end on one of the gripper rails respectively. A bushing carries the supporting elements 12, 13 and has a toothed wheel, the first and second toothed racks meshing simultaneously with the toothed wheel on opposite circumferential sides of the toothed wheel.

One of the advantages provided by the present invention is its use of already existing devices which are required anyhow. In certain embodiments of the invention, a guide bar is provided which is carried along by the gripper rails and is therefore completely independent of additional guiding devices which are fixed to the frame or are stationary. In certain embodiments of the invention, there are no guiding devices for the supporting elements.

Other objects, advantages and novel features of the present invention will become apparent from the following detailed description of the invention when considered in conjunction with the accompanying drawings.

BRIEF DESCRIPTION OF THE DRAWINGS

FIG. 1 is a view of the removal area for double parts on a press with a first embodiment according to the invention.

FIG. 2 is a sectional view corresponding to the intersection line II—II in FIG. 1.

FIG. 3 is a view of a detail of the areas indicated by reference number III in FIG. 2.

DETAILED DESCRIPTION OF THE DRAWINGS

Figures 4, 5, 6:
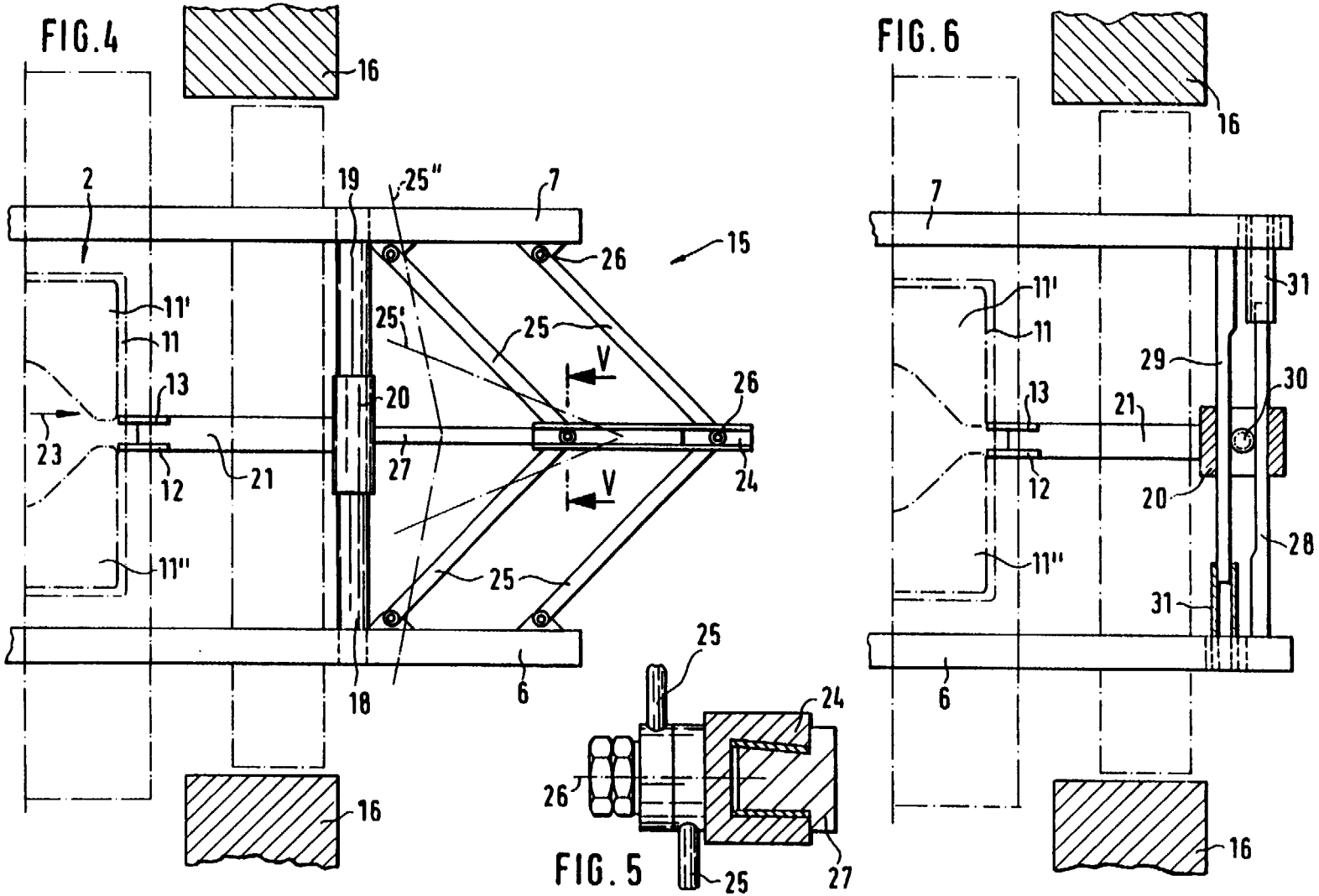
FIG. 4 is a top view of the removal area for double parts corresponding to a second embodiment of the present invention.
FIG. 5 is a sectional view according to the line V—V in FIG. 4.
FIG. 6 is a top view of the removal area for double parts corresponding to another embodiment of the present invention.

In FIG. 1, reference number 2 indicates the last machining stage of a press 1, which is only outlined in the drawing, and has the press stands 16. The machining stage includes a press slide 3, which can be moved up and down by the press drive, with an upper tool part 4 as well as a lower tool part 5 on the bedplate. Between the press stands 16, gripper rails 6, 7 extend along the direction 23 of the passing through of the gripper rails 6, 7, for the transfer movement of sheet metal parts 11 machined in the press. In a known manner, the gripper rails 6, 7 have gripping devices for the gripping of the sheet metal parts 11 in their edge areas which are close to the gripper rails. Reference number 15 shows a supporting device as a whole which is positioned for the supporting of the sheet metal parts 11 away from the grippers on the gripper rails 6, 7 in the areas between the gripper rails 6, 7. The support takes place via supporting elements 12, 13 which are moved along with the gripper rails by means of an attachment 21. The attachment 21 is fastened on a bushing 20 which is shown more clearly in FIG. 2. A three-axis movement means is schematically indicated in FIG. 1, this three-axis movement means providing vertical, longitudinal and traverse movement to the gripper rails 6, 7 in a conventional manner.

For the support of the bushing 20, an outer pipe 18 is rigidly fastened to one of the gripper rails 6, 7, and an inner pipe 19 is rigidly fastened to the other one of the gripper rails 6, 7 possibly by way of holding plates 8, 9. The pipes 18, 19 can be slid into one another in the manner of a telescope. The bushing 20 is slidably fitted onto one of the pipes or on both.

In order to obtain a center position of the bushing 20 between the gripper rails 6, 7, guiding devices 17 are arranged between the bushing 20 or, for example, the attachment 21 and a console fixed to the stand which may, at the same time, be a stand part for the conveyor belt 14. The running surface 22 in FIG. 3 applies to such a construction. Depending on the adjustment of the basic width or the opening width of the gripper rails 6, 7, the inner pipe 19 is immersed more or less far in the outer pipe 18. The pipes may have a multi-profiled shape and therefore may be constructed to be polygonal. By means of lifting devices, the sheet metal parts 11 may be lifted out of the tool bottom part 5 to such an extent that an additional movement of the supporting elements 12, 13 in the vertical direction is not necessary. Because of the moving-along of the pipes 18, 19 into the position indicated by means of reference number 10, the sheet metal parts 11 can be deposited on the forward left area of the conveyor belt 14. The taking-over or transfer of the sheet metal parts may take place by means of pushers on the conveyor belt 14 or by means of an additional movement of the supporting elements 12, 13 in the vertical direction.

FIG. 4 shows a second embodiment with gripper rails 6, 7 that can be moved between the stands 16 of the press; a sheet metal part 11 that was separated in the machining stage 2 into two individual sheet metal parts 11', 11"; as well as a supporting device 15. The supporting device 15 comprises the pipes—the outer pipe 18 and the inner pipe 19—which were shown in FIGS. 1 and 2 and which are rigidly fastened to the gripper rails 6, 7 and can be telescopically slid into one another in the area of the bushing 20. An attachment 21 in the manner of a support for the supporting elements 12, 13 is fastened to the bushing 20. A guide bar 27 is also rigidly fastened to the bushing 20 and, at its other end, is disposed in a guide rail 24 so that it can be displaced in the direction of the passing-through of the press 23.

The guide rail 24 is always held in the center with respect to the gripper rails 6, 7 by means of a parallel linkage comprising parallel rods 25. For this purpose, the parallel rods 25 are disposed in pivot bearings 26 on the gripper rails 6, 7 and the guide rail 24. For the purpose of showing details, FIG. 5 illustrates a bearing point 26 according to the course of the intersection V—V in FIG. 4. The construction lines 25', 25" show the different diagonal positions of the parallel rods 25 when the openings widths of the gripper rails 6, 7 differ.

FIG. 6 shows another embodiment with gripper rails 6, 7 which can be moved between the stands 16 of a press. The gripper rails carry toothed racks 28, 29 which extend in parallel to one another and are slidable in guide bushes 31 fixed to the gripper rails. The toothings of the toothed racks 28, 29 face one another and mesh with the toothing of a toothed wheel 30 which is rotatably disposed on the bushing 20 so that during opening-closing movements of the gripper rails 6, 7, the bushing 20 remains in the center with respect to them. The bushing 20 comprises the supporting elements 12, 13, 21 for the support of the individual sheet metal parts 11', 11" which were cut from the sheet metal part 11 in the, for example, last machining stage 2 of the press by means of a separating cutting.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. In a system having a mechanism for removing sheet metal double parts from a last machining stage of a press and two gripper rails of a transfer device for moving said sheet metal double parts through the press, said two gripper rails being moveable in three axes and interacting with the mechanism, the mechanism comprising:

supporting elements which reach under the sheet metal parts and are moveable along with the gripper rails in lifting and lowering directions and in transfer and return directions;

an outer pipe and an inner pipe which are fitted at one end telescopically with the inner pipe slidable in the outer pipe in a direction transverse to a passing through direction of the press between the gripper rails, and are firmly connected with the gripper rails by means of the ends which are away from the telescopic connection;

a bushing disposed on at least one of said pipes such that said pipe is slidably received within said bushing, said bushing carrying the supporting elements;

at least one running surface for the center supporting position of the bushing which is formed between an attachment fastened on the bushing and configured to support the supporting elements and a part which is fixed to a stand.

2. In a system comprising a mechanism for removing sheet metal double parts from a last machining stage of a press and two gripper rails, which are moveable in three axes, of a transfer device for moving said sheet metal double parts through the press, in which said two gripper rails are configured to interact with the mechanism the mechanism comprising:

supporting elements which reach under the sheet metal parts and are moveable along with the gripper rails in lifting and lowering directions and in transfer and return directions;

an outer pipe and an inner pipe which are fitted at one end telescopically with the inner pipe slidable in the outer pipe in a direction transverse to a passing through direction of the press between the gripper rails, and are firmly connected with the gripper rails by means of the ends which are away from the telescopic connection;

a bushing disposed on at least one of said pipes such that said pipe is slidably received within said bushing, said bushing carrying the supporting elements;

a guiding rail coupled to the gripper rails so as to move along with the gripper rails;

a guide bar coupled to said bushing and slidably disposed in the guiding rail;

parallel rods which are articulated on each of the gripper rails and the guiding rail to form a double parallel control arrangement for the guide bar.

3. In a system including a mechanism for removing sheet metal double parts from a last machining stage of a press, and two gripper rails, which are moveable in three axes, of a transfer device for moving said sheet metal double parts through the press, the two gripper rails being arranged to interact with the mechanism, the mechanism comprising:

supporting elements which reach under the sheet metal parts and are moveable along with the gripper rails in lifting and lowering directions and in transfer and return directions;

a first toothed rack and a second toothed rack which extend transversely with respect to a passing-through direction of the press and in parallel to one another between the gripper rails, each said toothed rack being fastened at one end on one of the gripper rails respectively;

a bushing that carries the supporting elements and which has a toothed wheel, the first and second toothed racks meshing simultaneously with the toothed wheel on opposite circumferential sides of the toothed wheel.

* * * * *